US011950645B2

(12) United States Patent
Yanagisawa et al.

(10) Patent No.: US 11,950,645 B2
(45) Date of Patent: Apr. 9, 2024

(54) WEARABLE AIRBAG DEVICE

(71) Applicant: TOYODA GOSEI CO., LTD., Kiyosu (JP)

(72) Inventors: Toshihito Yanagisawa, Kiyosu (JP); Yusuke Kawamura, Kiyosu (JP); Wataru Miura, Kiyosu (JP)

(73) Assignee: TOYODA GOSEI CO., LTD., Aichi (JP)

( * ) Notice: Subject to any disclaimer, the term of this patent is extended or adjusted under 35 U.S.C. 154(b) by 0 days.

(21) Appl. No.: 17/554,185

(22) Filed: Dec. 17, 2021

(65) Prior Publication Data

US 2022/0248779 A1 Aug. 11, 2022

(30) Foreign Application Priority Data

Feb. 5, 2021 (JP) ..... 2021-017574

(51) Int. Cl.
*A41D 13/05* (2006.01)
*A41D 13/018* (2006.01)

(52) U.S. Cl.
CPC ..... *A41D 13/0506* (2013.01); *A41D 13/018* (2013.01)

(58) Field of Classification Search
CPC .. A41D 15/04; A41D 13/0506; A41D 13/018; A41D 13/0155; A45B 9/00
See application file for complete search history.

(56) References Cited

U.S. PATENT DOCUMENTS 5,500,952 A * 3/1996 Keyes ..... A41D 13/018 2/908
2005/0067816 A1* 3/2005 Buckman ..... A61B 5/6805 280/730.1
2012/0131718 A1 5/2012 Uchida et al.
(Continued)

FOREIGN PATENT DOCUMENTS

JP 2011-144490 A 7/2011
WO 2010/090317 A1 8/2010
WO 2019/207474 A1 10/2019

OTHER PUBLICATIONS

Office Action dated Sep. 5, 2023 issued in corresponding Japanese Patent Application No. 2021-017574 (and English machine translation).

*Primary Examiner* — Khoa D Huynh
*Assistant Examiner* — Akwokwo Olabisi Redhead
(74) *Attorney, Agent, or Firm* — POSZ LAW GROUP, PLC

(57) ABSTRACT

A wearable airbag device includes a wearable member and an airbag held by the wearable member and inflatable with an inflation gas fed from a gas generator. The airbag includes a bag body that forms an outer shell of the airbag which includes an inner wall adapted to face the wearer when worn and an outer wall opposite to the inner wall, the bag body including one or more protecting inflatable portions for covering and protecting one or more targeted body parts respectively, and an inner bag that is disposed inside the bag body and configured to be inflated with the inflation gas from the gas generator. The inner bag includes one or more supply ports for forwarding the inflation gas to the bag body. Each of the supply ports is configured to emit the inflation gas toward one of the protecting inflatable portions and toward the outer wall.

7 Claims, 14 Drawing Sheets

(56) References Cited

U.S. PATENT DOCUMENTS

2013/0276213 A1* 10/2013 Olsson ..... A42B 3/122
2/468
2018/0215339 A1* 8/2018 Nakanishi ..... B60R 21/239

* cited by examiner

WEARABLE AIRBAG DEVICE

CROSS REFERENCE TO RELATED APPLICATIONS

The present application claims priority from Japanese Patent Application No. 2021-17574 of Yanagisawa et al., filed on Feb. 5, 2021, the entire disclosure of which is incorporated herein by reference.

BACKGROUND

1. Technical Field

The present disclosure relates to a wearable airbag device that is adapted to be worn by a wearer and configured to deploy an airbag in order to protect a targeted body part of the wearer in the event of a fall or the like of the wearer.

2. Description of Related Art

WO 2010/090317 A1 discloses a wearable airbag device that is adapted be worn by a wearer and configured to deploy more than one airbag in order to protect such body parts as the hip, head, and sides upon sensing a fall of the wearer (an elderly person, by way of example) by an acceleration sensor and so on. The airbags are configured to be inflated by an inflation gas fed by a gas generator. WO2019/207474 A1 discloses a wearable airbag device that is configured to actuate a gas generator to inflate an airbag with an inflation gas so the airbag is deployed around the hip of the wearer.

None of the patent literatures referred to above discusses concretely how the inflation gas emitted from the gas generator flows inside the airbag. If an inflation gas emitted from the gas generator flows toward the wearer, the gas may give the wearer an undue pressure, or may cause an inflated portion of the airbag for covering the targeted body part to bounce back and float away from the body of the wearer, which may lead to failure of the airbag to be quickly deployed over the targeted body part.

Therefore, it would be desirable to provide a wearable airbag device that is able to control the flow of an inflation gas emitted from the gas generator in order to deploy the airbag steadily and accurately over a targeted body part.

SUMMARY

An exemplary embodiment of the present disclosure relates to a wearable airbag device including: a wearable member that is adapted to be worn by a wearer; a gas generator that is held by the wearable member and is configured to discharge an inflation gas; and an airbag that is held by the wearable member and is configured to be inflated with the inflation gas fed from the gas generator for protecting one or more targeted body parts of the wearer. The airbag includes: a bag body that forms an outer shell of the airbag which includes an inner wall that is adapted to face the wearer when worn and an outer wall that is adapted to face away from the wearer when worn, the bag body including one or more protecting inflatable portions that are configured to cover the one or more targeted body parts respectively when inflated; and an inner bag that is disposed inside the bag body and configured to be inflated with the inflation gas fed from the gas generator, the inner bag including one or more supply ports for forwarding the inflation gas fed from the gas generator to the bag body to inflate the bag body. Each of the one or more supply ports of the inner bag is configured to emit the inflation gas toward one of the one or more protecting inflatable portions and toward the outer wall.

DETAILED DESCRIPTION

Figure 1B:
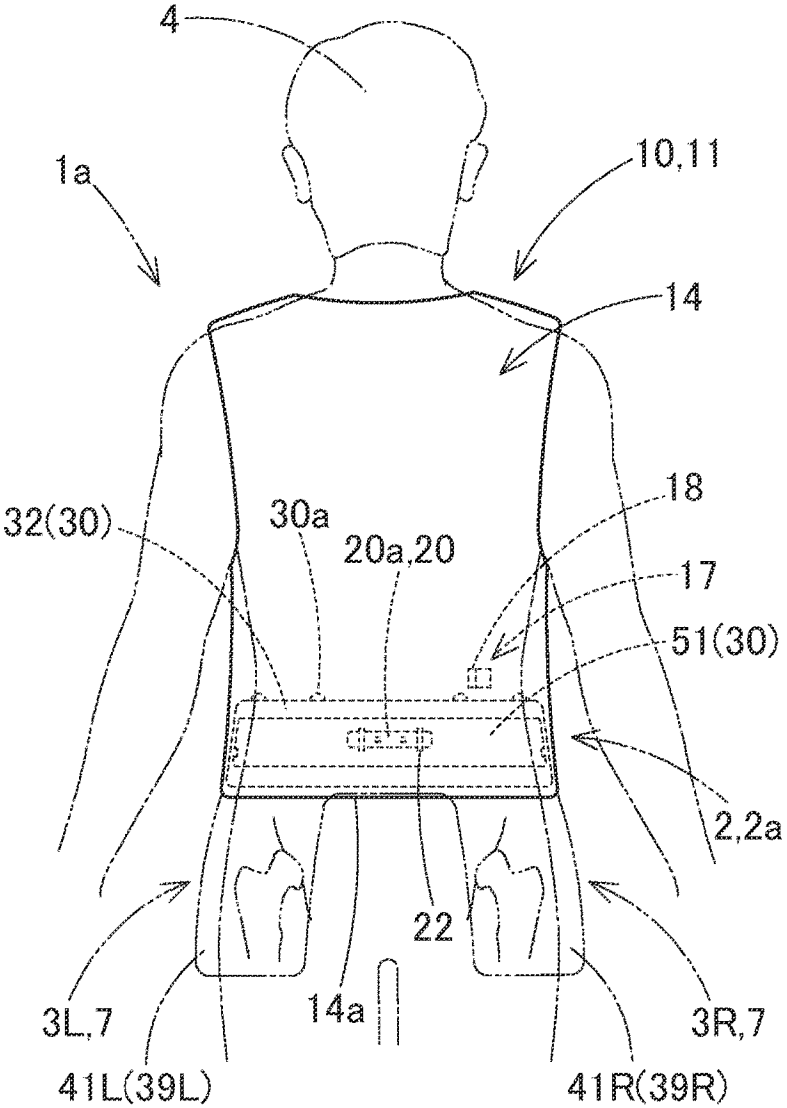
FIG. 1B is a schematic back view of the wearable airbag device of FIG. 1A in the worn state.
Figure 1A:
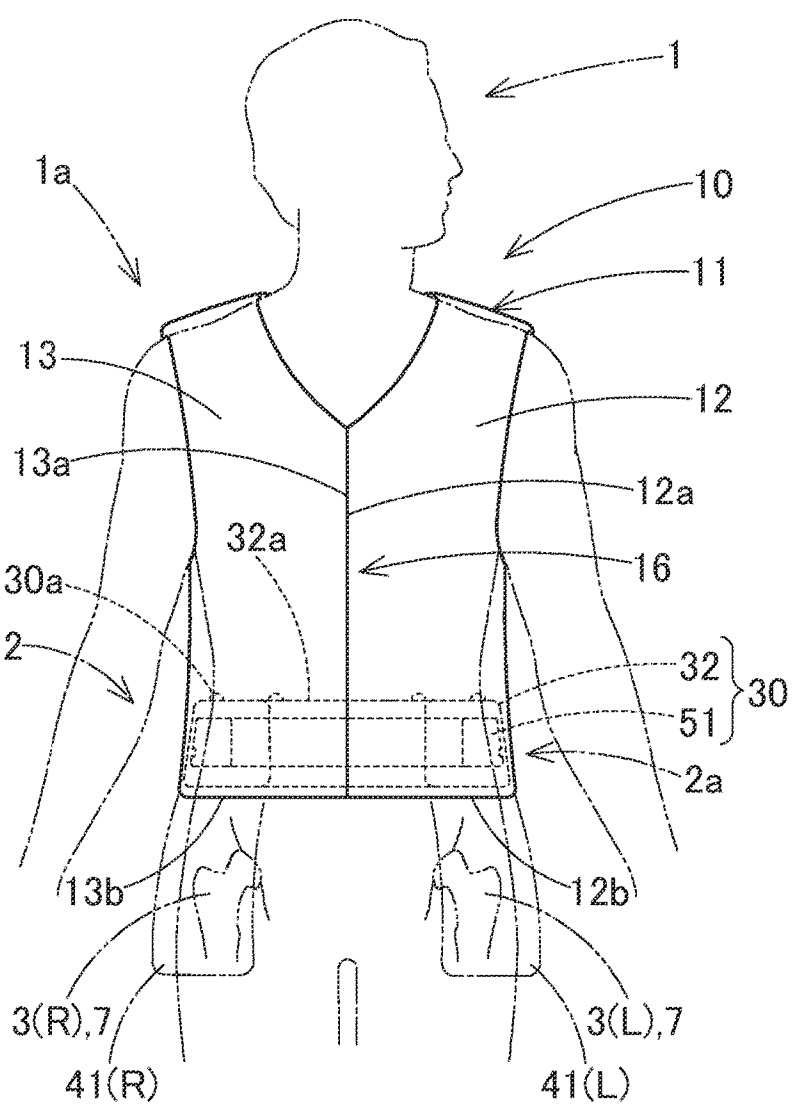
FIG. 1A is a schematic front view of a wearable airbag device in accordance with the first embodiment in a worn state.

Exemplary embodiments of the present disclosure are described below with reference to the accompanying drawings. However, the invention is not limited to the embodiments disclosed herein. All modifications within the appended claims and equivalents relative thereto are intended to be encompassed in the scope of the claims.

Referring to FIGS. 1 to 5, a wearable airbag device 10 in accordance with the first embodiment is adapted to be worn by a wearer 1 such as an elderly person and configured to inflate and deploy an airbag 30 for protecting left and right trochanters (greater trochanters) 3 (3L, 3R) in the hip 2 of the wearer 1 as targeted body parts 7. The wearable airbag device 10 includes a gas generator 20, an airbag 30 that is configured to be inflated with an inflation gas G fed from the gas generator 20, an operation control device 17 that includes a sensor part 18 for detecting a fall of the wearer 1 and is configured to actuate the gas generator 20, and a wearable member 11 that is formed into a vest and holds the gas generator 20, the airbag 30 and the operation control device 17.

The wearable member 11 is formed into a vest that is wearable on the upper body 1*a*. The wearable member 11 includes a left front portion 12 and a right front portion 13 for covering the front side of the upper body 1*a* of the wearer 1 in combination, a back portion 14 for covering the back of the upper body 1*a* of the wearer 1, and a fastening member 16 such as a zipper for fastening inner edges 12*a* and 13*a* of the left front portion 12 and the right front portion 13 together.

The operation control device 17 includes a sensor part 18 that includes an angular velocity sensor capable of sensing angular velocities around three axes in up and down, front and rear, and left and right directions, and an acceleration sensor capable of sensing accelerations in the three-axis directions. The operation control device 17 is configured to actuate the gas generator 20 in response to a signal fed from the sensor part 18 which has sensed a falling behavior different from a normal behavior of the wearer 1. More particularly, the operation control device 17 includes a determining means that is configured to determine based on various thresholds, and is configured to actuate the gas generator 20 upon sensing a fail of the wearer 1 based on the determination by the determining means. The operation control device 17 further includes a power source composed of a not-shown battery or the like for operation of the sensor part 18 and for emission of an actuating signal to the gas generator 20.

The operation control device 17 is stored in a not-shown cover or the like and attached to a lower portion 14*a* of the back portion 14 of the wearable member 11 so as not to be engaged with the clothing of the wearer 1, as can be seen in FIG. 1B.

Figure 2:
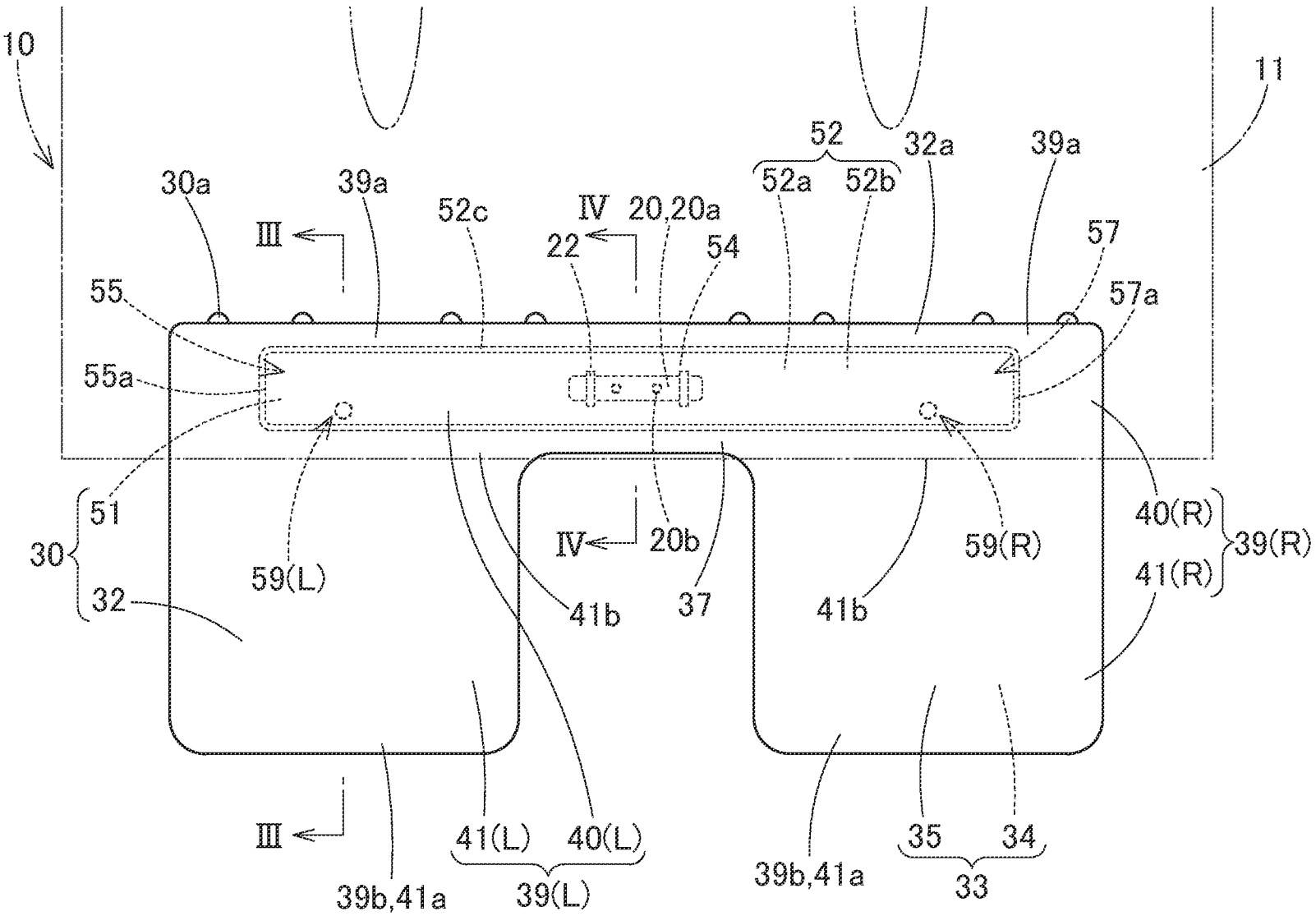
FIG. 2 is a schematic back view of an airbag for use in the wearable airbag device in accordance with the first embodiment as laid flat.
Figure 4:
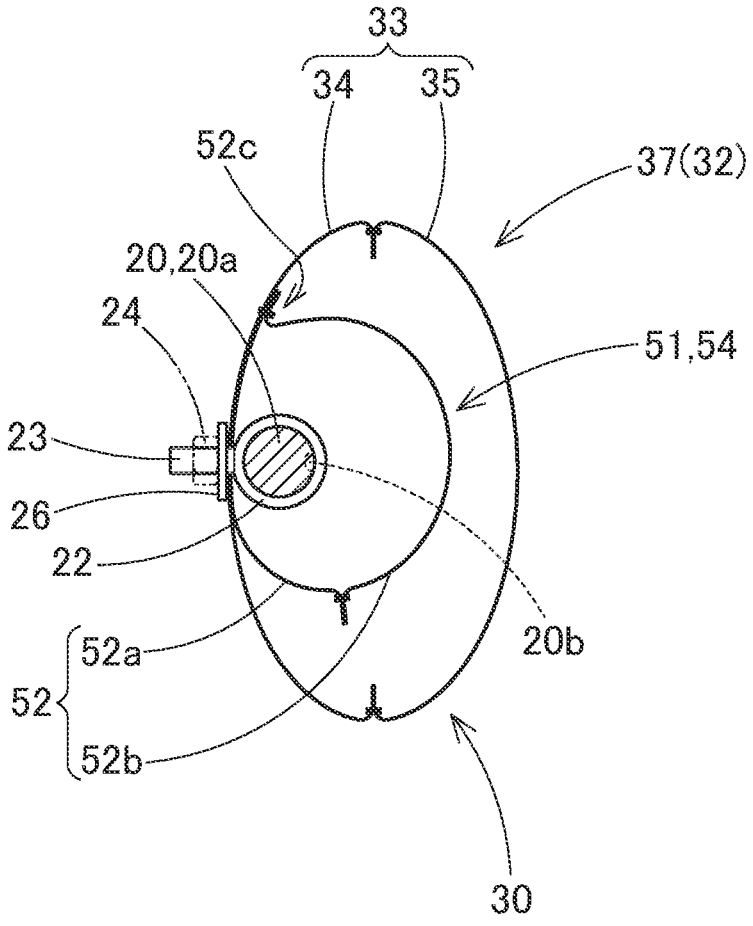
FIG. 4 is a schematic sectional view of the airbag of FIG. 2 as inflated taken along line IV-IV of FIG. 2.
Figure 5:
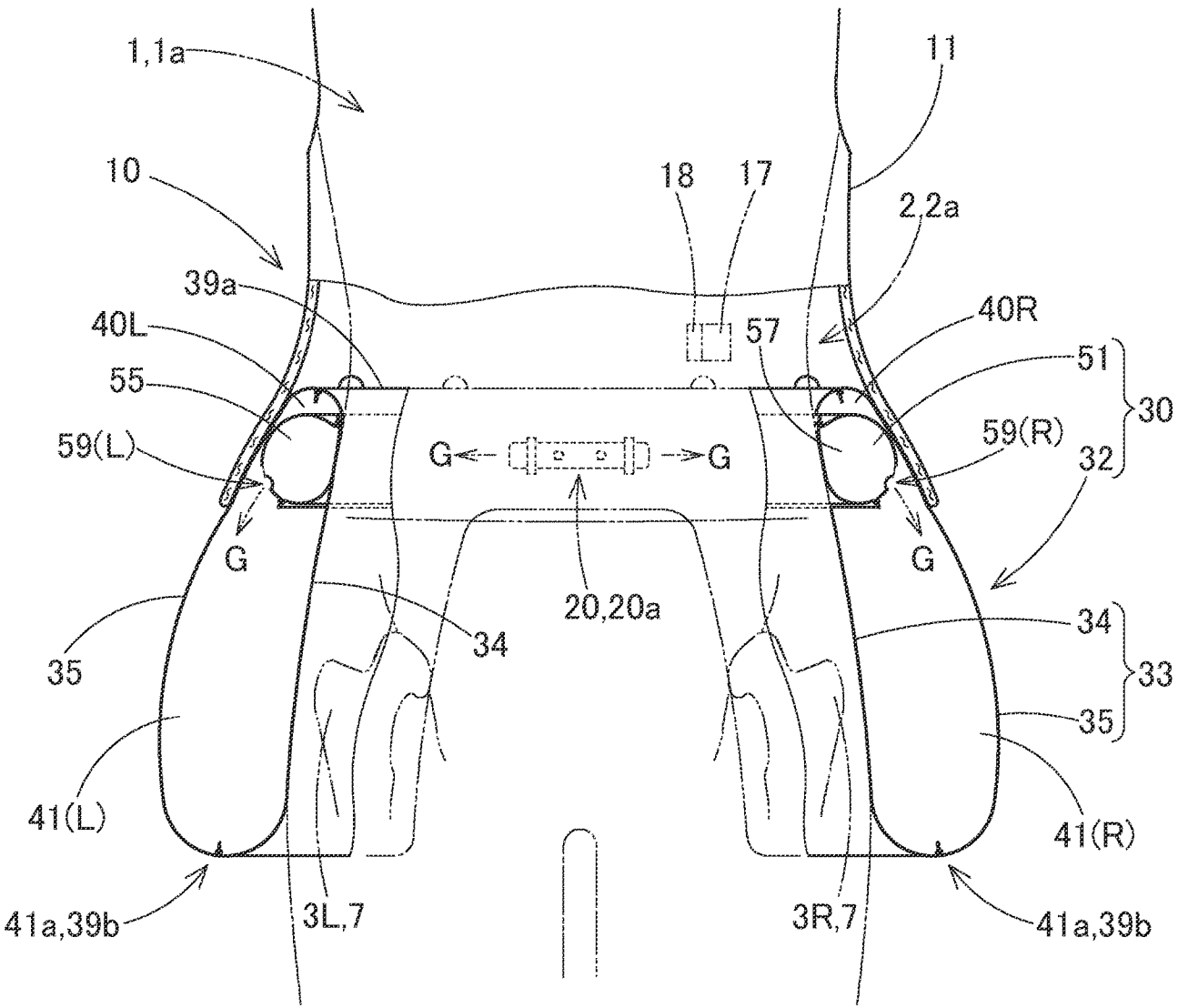
FIG. 5 is a schematic vertical sectional view of the wearable airbag device of the first embodiment as actuated.

Referring to FIGS. 2, 4 and 5, the gas generator 20 includes a body 20*a* that is substantially cylindrical in shape and contains an inflation gas G composed of carbon dioxide or the like in a compressed state, and two gas discharge ports 20*b* that are disposed on the outer circumference of the body 20*a*. The gas generator 20 is configured to discharge the inflation gas G which was stored in the body 20*a* from the gas discharge ports 20*b* in response to an actuating signal fed from the operation control device 17 that has sensed a fall of the wearer 1. The gas generator 20 of this specific embodiment is mounted on the airbag 30 with the use of two mounting brackets 22 each of which is tubular in shape and clamps the body 20*a*. Each of the mounting bracket 22 includes a mounting bolt 23. The gas generator 20 (the body 20*a*) as clamped by the mounting brackets 22 are stored in a later-described inner bag 51 of the airbag 30 having the mounting bolts 23 passed through the inner bag 51 and a later-described bag body 32 of the airbag 30 to protrude from the airbag 30, then the mounting bolts 23 are further passed through a holding plate 26 and then fastened with nuts 24, respectively. Thus the gas generator 20 is mounted on the airbag 30 in such a manner as to sandwich the inner bag 51 and bag body 32 with the mounting brackets 22 and holding plates 26. The two mounting brackets 22 are disposed each at a vicinity of an end of the body 20*a* of the gas generator 20 so as to be remote from the gas discharge ports 20*b*.

The airbag 30 includes a bag body 32 and an inner bag 51 disposed inside the bag body 32. The bag body 32 includes one or more protecting inflatable portions 41 configured to be deployed over the targeted body part(s). The inner bag 51 is configured to be inflated with an inflation gas G fed from the gas generator 20, and includes one or more supply ports 59 for supplying the inflation gas G to the bag body 32 so the bag body 32 is inflated.

In the first embodiment, each of the bag body 32 and inner bag 51 is formed of a woven fabric of polyester or the like having flexibility.

The bag body 32 constitutes an outer shell 33 of the airbag 30 that includes an inner wall 34 that is disposed toward the wearer 1 when worn and an outer wall 35 that faces away from the wearer 1 when worn. The bag body 32 includes two hip-protecting portions (as the protecting inflatable portions) 41 (41L, 41R) for covering the targeted body parts 3 (3L, 3R) of the wearer 1, respectively. The bag body 32 as inflated includes two, left and right main inflatable portions 39 (39L, 39R) that are located at left and right regions of the bag body 32 and each have a substantially rectangular board shape, and a communicating portion 37 that connects upper end regions of the main inflatable portions 39 (39L, 39R) and has a substantially rectangular board shape. The communicating portion 37 is adapted to be disposed at the back of the wearer 1 when worn. The inner wall 34 and outer wall 35 of the bag body 32 are substantially identical to one another in outer shape. The inner wall 34 forms regions to face the body of the wearer 1 of the left and right main inflatable portions 39 (39L, 39R) and communicating portion 37, and the outer wall 35 forms regions facing away from the wearer 1 of the left and right main inflatable portions 39 (39L, 39R) and communicating portion 37.

Each of the left and right main inflatable portions 39 (39L, 39R) includes, in the lower region, a hip-protecting portion (as the protecting inflatable portion) 41 (41L/41R) for covering the left/right trochanter 3L/3R in the hip 2 of the wearer 1, and includes an edge inflatable portion 40 (40L/40R) in which a left/right end region of the inner bag 51 is stored, in a vicinity of the upper edge 39*a*.

The inner bag 51 is designed to be inflated into a columnar shape elongated in a left and right direction assuming that the airbag 30 is inflated in a flatly developed sate. A central portion 54 in the left and right direction of the inner bag 51 is stored inside the communicating portion 37 of the bag body 32, and a left portion 55 and a right portion 57, each of which extends to the left/right from the central portion 54, are stored inside the edge inflatable portions 40 (40L, 40R) in the vicinity of the upper edges 39*a* of the main inflatable portion 39 (39L, 39R) of the bag body 32, respectively.

Figure 3:
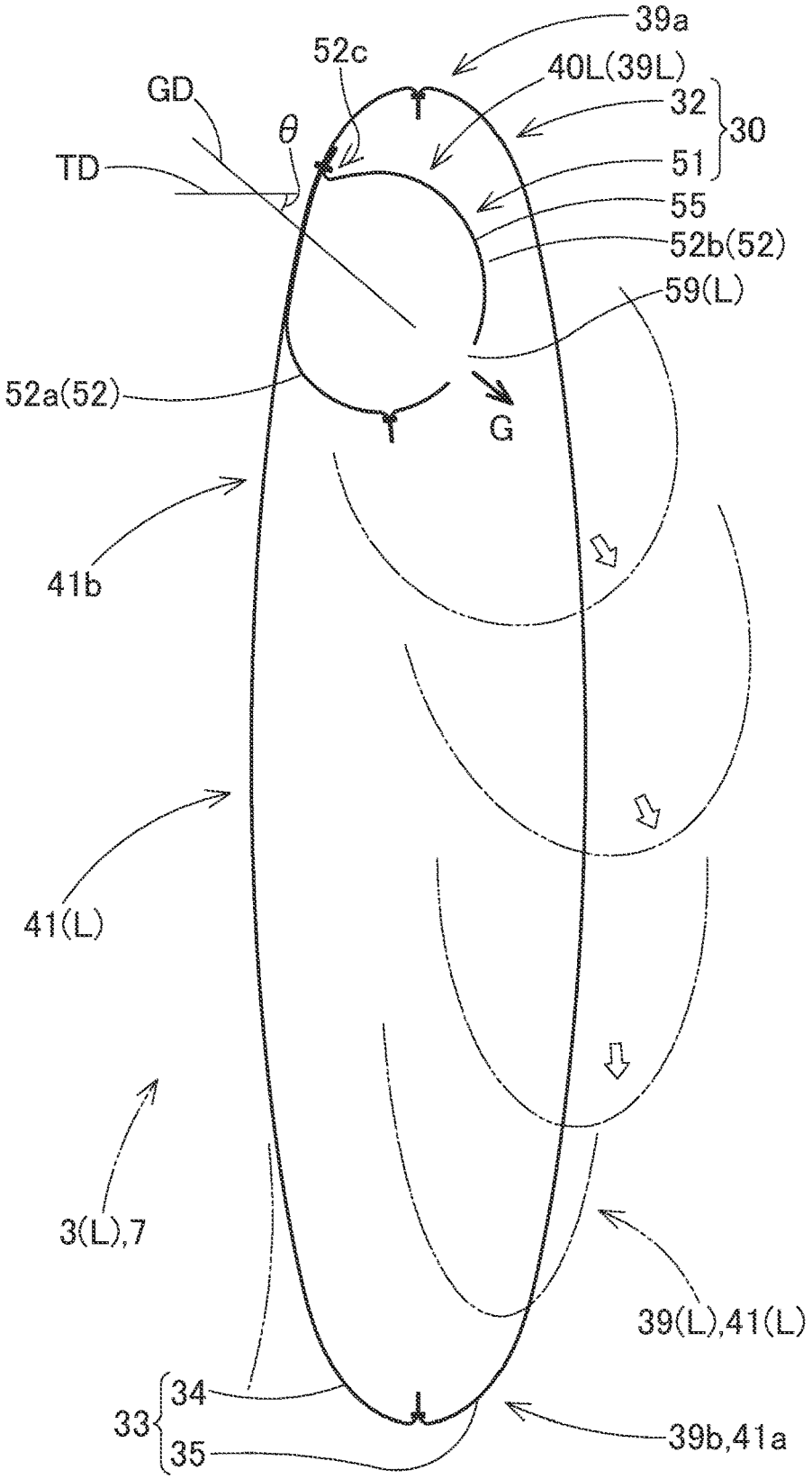
FIG. 3 is a schematic sectional view of the airbag of FIG. 2 as inflated taken along line III-III of FIG. 2.

The above-described gas generator 20 is stored inside the central portion 54 of the inner bag 51 so the central portion 54 serves as a reception portion of the inflation gas. The inner bag 51 includes, in the left portion 55 and right portion 57, one each supply port 59 (59L/59R) via which the inflation gas G is delivered or forwarded to the bag body 32, Each of the supply ports 59 (59L, 59R) is round in opening shape, and is designed so that, on the left portion 55/right portion 57 as inflated in a columnar shape, a direction orthogonal to the opening plane points obliquely downward and outward. In other words, each of the supply ports 59 (59L, 59R) is designed so that an outflow direction GD of the inflation gas G flowing out of the supply port 59L/59R into the bag body 32 points toward the hip protecting portion (as the protecting inflatable portion) 41L/41R and toward the outer wall 35. Even more particularly, as can be seen in FIG. 3, each of the supply ports 59 (59L, 59R) is designed so that the outflow direction GD of the inflation gas G flowing out of the supply port 59L/59R into the bag body 32 points downward so as to obliquely intersect with an opposing direction TD of the inner wall 34 and outer wall 35 of the bag body 32 (a substantially horizontal direction, in this specific embodiment) at an approximately 45° angle θ.

The inner bag 51 of the first embodiment is composed of an inner base cloth 52*a* and an outer base cloth 52*b* each of which has a band shape elongated in a left and right direction and which are sewn together by the entire circumferential edge. The supply ports 59 (59L, 59R) are respectively located at a lower region of left and right end regions of the outer base cloth 52*b*. A seam 52*c* of the inner base cloth 52*a* and outer base cloth 52*b* located at upper edge of the inner bag 51 is joined to the inner wall 34 of the bag body 32 so that the inner bag 51 may not slip in position inside the bag body 32.

The airbag 30 is provided, in the upper edge 32*a* of the bag body 32, with a plurality of mounting tabs 30*a* (FIG. 2) for mounting on the wearable member 11. The airbag 30 is mounted on and held by the wearable member 11 by the mounting tabs 30*a* which are attached to an inner surface of the wearable member 11 by sewing or the like. In a standby state of the wearable airbag device 10, the airbag 30 is held by the wearable member 11 in a folded configuration in which the lower edge 39*b* of each of the main inflatable portions 39 is brought close to the upper edge 39*a*.

To produce the wearable airbag device 10 of the first embodiment, firstly, the inner bag 51 is formed with the gas generator 20 housed inside. The inner bag 51 is then placed at a predetermined position on the inner wall 34 of the bag body 32, and joined to the inner wall 34 by the seam 32*c*. Then the inner wall 34 and outer wall 35 of the bag body 32 are mated so the outer surfaces face one another, then joined together by sewing or the like by the outer circumferential edges, leaving a part unsewn. Then the bag body 32 is reversed inside out through the use of the unsewn part, and the unsewn part is sewn up. The airbag 30 is completed if then the mounting tabs 30*b* are attached to the upper edge 32*a* of the bag body 32.

The mounting bolt 23 of each of the mounting brackets 22 which hold the body 20*a* is put through the inner wall 34 of the bag body 32 when the inner bag 51 is placed on the inner wall 34, and put through the holding plate 26 and nut 24 fastened after the airbag 30 is formed. Thus the gas generator 20 is assembled with the airbag 30. A signal wire for actuating the gas generator 20 is taken out of not-shown through holes formed respectively in the inner bag 51 and inner wall 34. Subsequently, each of the main inflatable portions 39 is folded in such a manner that the lower edge 39*b* is brought close to the upper edge 39*a*, then the airbag 30 is mounted on the wearable member 11 with the use of the mounting tabs 30*a*. Then a not-shown leading wire extending from the operation control device 17 which has been mounted on the wearable member 11 in advance is connected to the signal wire extending from the gas generator 20. Thus the wearable airbag device 10 is completed, in which the airbag 30, the gas generator 20 and so on are held by the wearable member 11.

The wearer 1 puts the wearable airbag device 10 (i.e. the wearable member 11) in accordance with the first embodiment on the upper body 1*a* using the fastening member 16. If the wearer 1 wearing the wearable airbag device 10 falls, the operation control device 17 actuates the gas generator 20 in response to a signal fed from the sensor part 18, so the gas generator 20 discharges an inflation gas G from the gas discharge ports 20*b*. The inflation gas G inflates the inner bag 51 stored inside the bag body 32 first, then flows into the bag body 32 via the supply ports 59 (59L, 59R) formed in the inner bag 51, thus inflates the bag body 32. At this time, the inflation gas G flowing out of the inner bag 51 flows toward the hip protecting portion (as the protecting inflatable portion) 41L/41R and toward the outer wall 35 as shown in FIG. 3, thus inflates the hip protecting portion (as the protecting inflatable portion) 41L/41R quickly and adequately without pushing the wearer 1 so the hip protecting portion 41L/41R is able to cover the trochanter 3 (3L, 3R) as the targeted body part, as can be seen in FIGS. 3 and 5. Furthermore, since the inflation gas G is supplied to the bag body 32 from the supply ports 59 (59L, 59R) formed on the inner bag 51, once the inner bag 51 has completed inflation, the opening plane of each of the supply ports 59 (59L/59R) is positioned at a predetermined position, so that the deployment behavior of the bag body 32 is stabilized with the stabilized outflow direction GD of inflation gas G.

Therefore, the wearable airbag device 10 in accordance with the first embodiment is able to stabilize the deployment behavior of the airbag 30 so the airbag 30 is able to cover the trochanters 3 (3L, 3R) as the targeted body parts accurately by stabilizing the flow of the inflation gas G at airbag deployment.

In the wearable airbag device 10 in accordance with the first embodiment, each of the supply ports 59 (59L, 59R) is configured such that the outflow direction GD of the inflation gas G flowing out of the supply port 59L/59R into the bag body 32 obliquely intersects with the opposing direction TD of the inner wall 34 and outer wall 35 of the bag body 32, as can be seen in FIGS. 3 and 5.

This configuration will make the inflation gas G flowing out of the inner bag 51 to the bag body 32 flow toward the leading end (or lower end) of the hip protecting portion (as the protecting inflatable portion) 41L/41R in the outer wall 35, not toward the body of the wearer 1. Therefore, the wearable airbag device 10 is able to attain an avoidance of giving pressure to the wearer 1 as well as quick deployment of the hip protecting portions 41.

In the wearable airbag device 10 in accordance with the first embodiment, moreover, the bag body 32 as inflated includes two hip protecting portions 41 (41L, 41R) that are respectively located at left and right regions of the bag body 32 and serve as the protecting inflatable portions for covering left and right trochanters 3 (3L, 3R) of femurs of the wearer 1, and the communicating portion 37 that is located between the two hip protecting portions 41 (41L, 41R) in a vicinity of the upper edge 32*a* of the bag body 32. The communicating portion 37 is in gas communication with both of the two hip protecting portions 41L, 41R and adapted to be disposed at the back of the wearer 1 when worn. The inner bag 51 includes the central portion 54 that is disposed inside the communicating portion 37 of the bag body 32, and the left portion 55 and right portion 57 that respectively extend from opposite ends of the central portion 54 in the left and right direction. The left portion 55 and right portion 57 are disposed in a vicinity of the upper edge 41*b* of the left and right hip protecting portions 41L, 41R (more particularly, in the edge inflatable portions 40L, 40R), respectively, inside the bag body 32. The central portion 54 is configured to receive the inflation gas G from the gas generator 20. Each of the left portion 55 and the right portion 57 includes the supply port 59L/59R in a vicinity of the leading end 55*a*/57*a*.

With this configuration, the wearable airbag device 10 as actuated is able to cover the left and right trochanters 3L, 3R of the wearer 1 with the left and right hip protecting portions 41L, 41R. By covering the trochanters 3L, 3R, the wearable airbag device 10 is able to prevent a fracture or the like of the trochanter 3L/3R of an elderly wearer 1 at fall, which is likely to take a long time to treat. Since the central portion 54 of the inner bag 51 which serves as the reception portion of inflation gas G is disposed inside the communicating portion 37 of the bag body 32 which are disposed between the left and right hip protecting portions 41 (41L, 41R), when the wearable airbag device 10 is actuated, an inflation gas G will be firstly delivered to the left portion 55 and right portion 57 from the central portion 54 evenly, so that the gas G will be forwarded to the left and right hip protecting portions 41 (41L, 41R) via the supply ports 59 (59L, 59R) to inflate the hip protecting portions 41 (41L, 41R) evenly and quickly.

The airbag may be configured to protect the head 4 of the wearer 1 as the targeted body part 7, in addition to the trochanters 3 (3L, 3R), like in a wearable airbag device 10A depicted in FIGS. 6 to 10.

Figure 6:
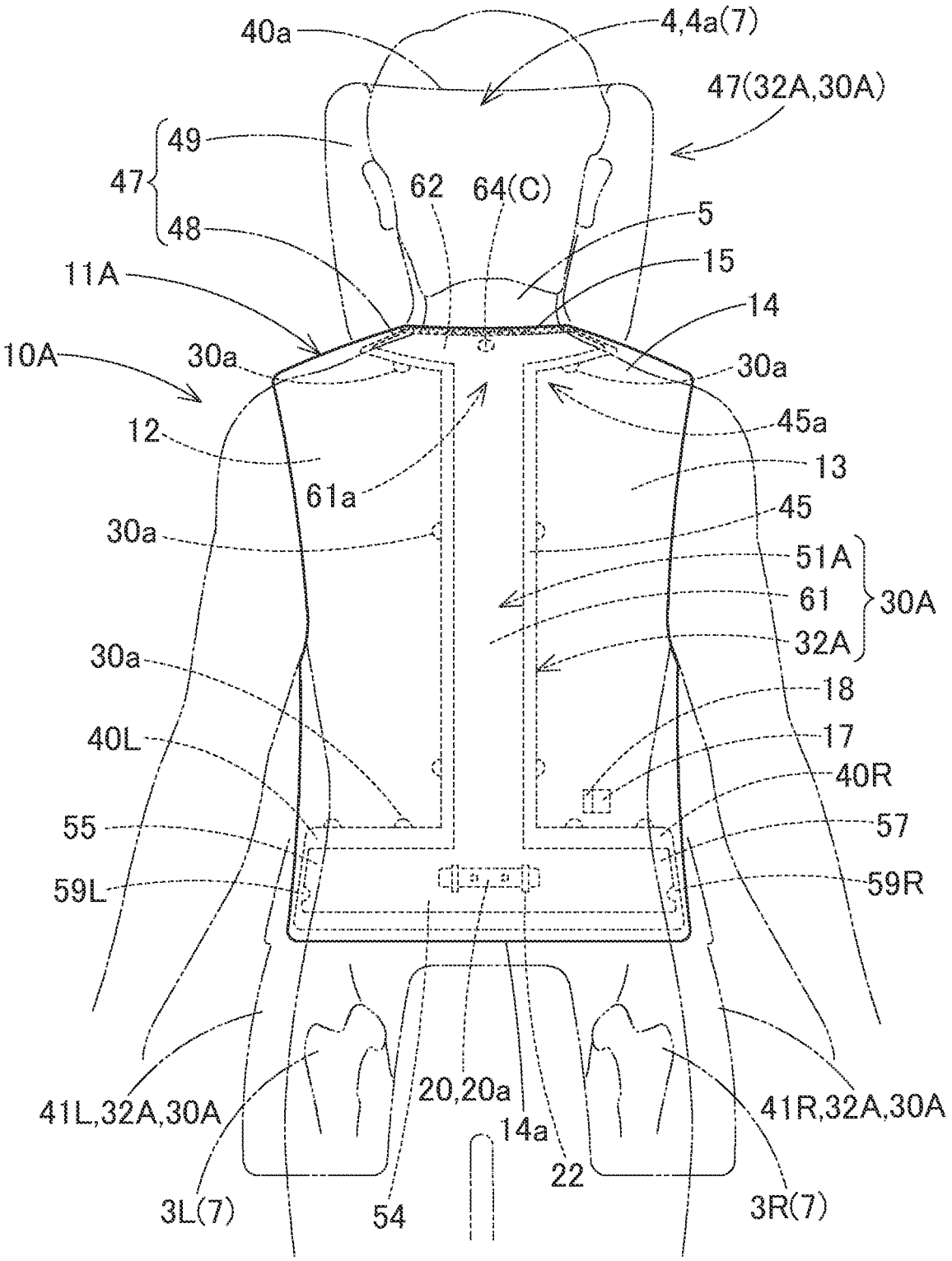
FIG. 6 is a schematic back view of a wearer as wearing a wearable airbag device in accordance with the second embodiment.

In an airbag 30A of the wearable airbag device 10A, a bag body 32A as inflated includes a vertical inflatable portion 45 that extends upward from the communicating portion 37 and is adapted to be disposed in a vicinity of the center in a left and right direction of the back of the wearer 1 when worn. The airbag body 32A further includes, as the protecting inflatable portion, a head protecting portion 49 for deployment over the back 4*a* of the head 4 of the wearer 1, at a vicinity of the upper end 45*a* of the vertical inflatable portion 45, in addition to the hip protecting portions 41L, 41R. More specifically, there is disposed a top-side inflatable portion 47 that is configured to be inflated into a substantially rectangular board extending upward from the vicinity of the upper end 45*a* of the vertical inflatable portion 45, The top-side inflatable portion 47 includes the head protecting portion 49 in the upper region, and an edge inflatable portion 48 in a vicinity of the lower end. A later-described neck-surrounding portion 62 of the inner bag 51A is stored in the edge inflatable portion 48. The edge inflatable portion 48 is provided with a plurality of mounting tabs 30*a* in the lower edge, and attached to a neck portion 15 of the wearable member 11A formed into a vest by the mounting tabs 30*a*, as can be seen in FIG. 6, The top-side inflatable portion 47 is configured such that the edge inflatable portion 48 is deployed along the neck portion 15 of the wearable member 11A and the head protecting portion 49 as the protecting inflatable portion extends upward from the edge inflatable portion 48 in a substantially half-pipe shape and is deployed around the back 4*a* of the head 4 of the wearer 1.

The vertical inflatable portion 45 is also provided with the mounting tabs 30*a* in both of left and right edges, and is attached to the back portion 14 of the wearable member 11A by the mounting tabs 30*a*.

Figure 7:
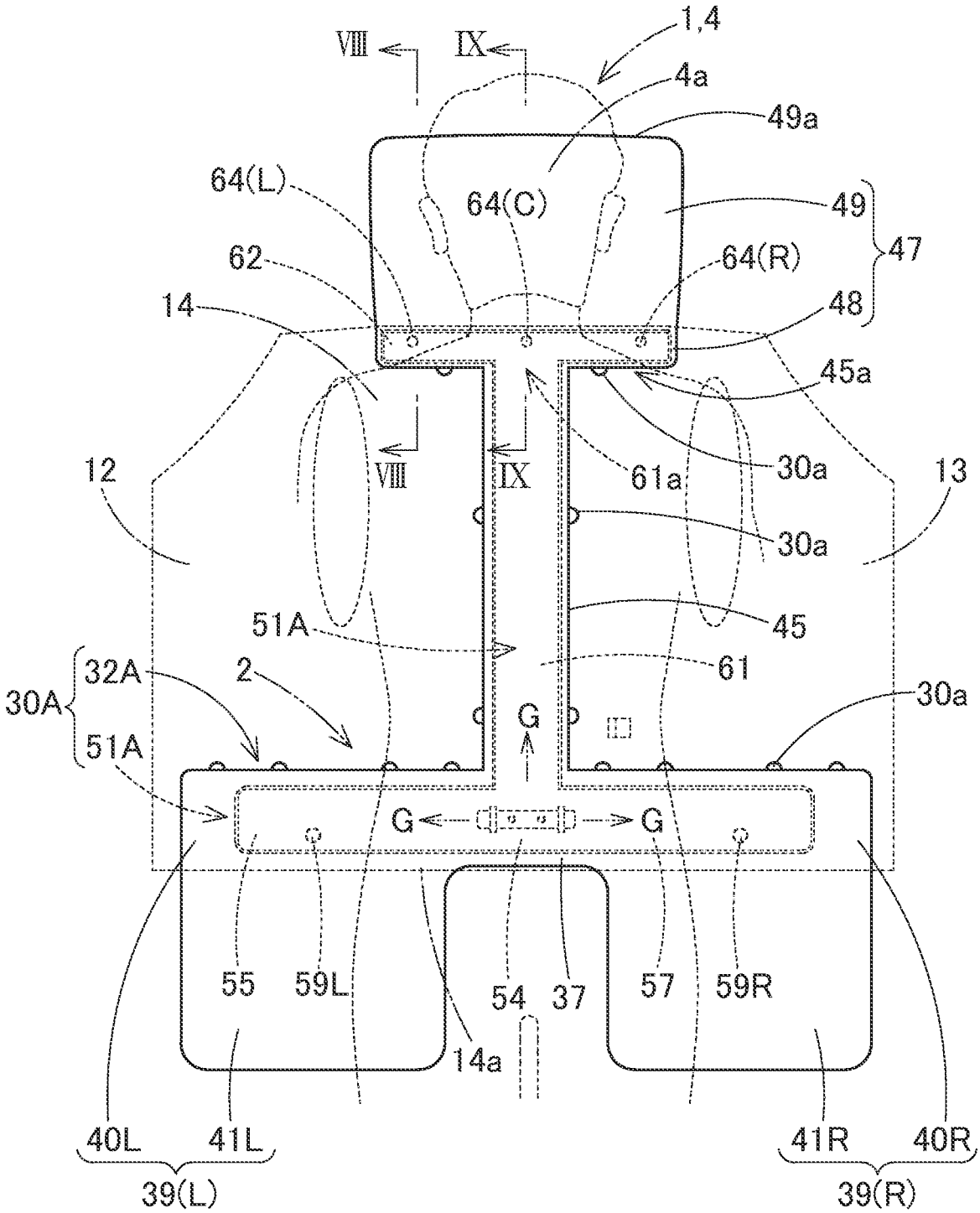
FIG. 7 is a schematic back view of the wearable airbag device of the second embodiment as laid flat.
Figure 8:
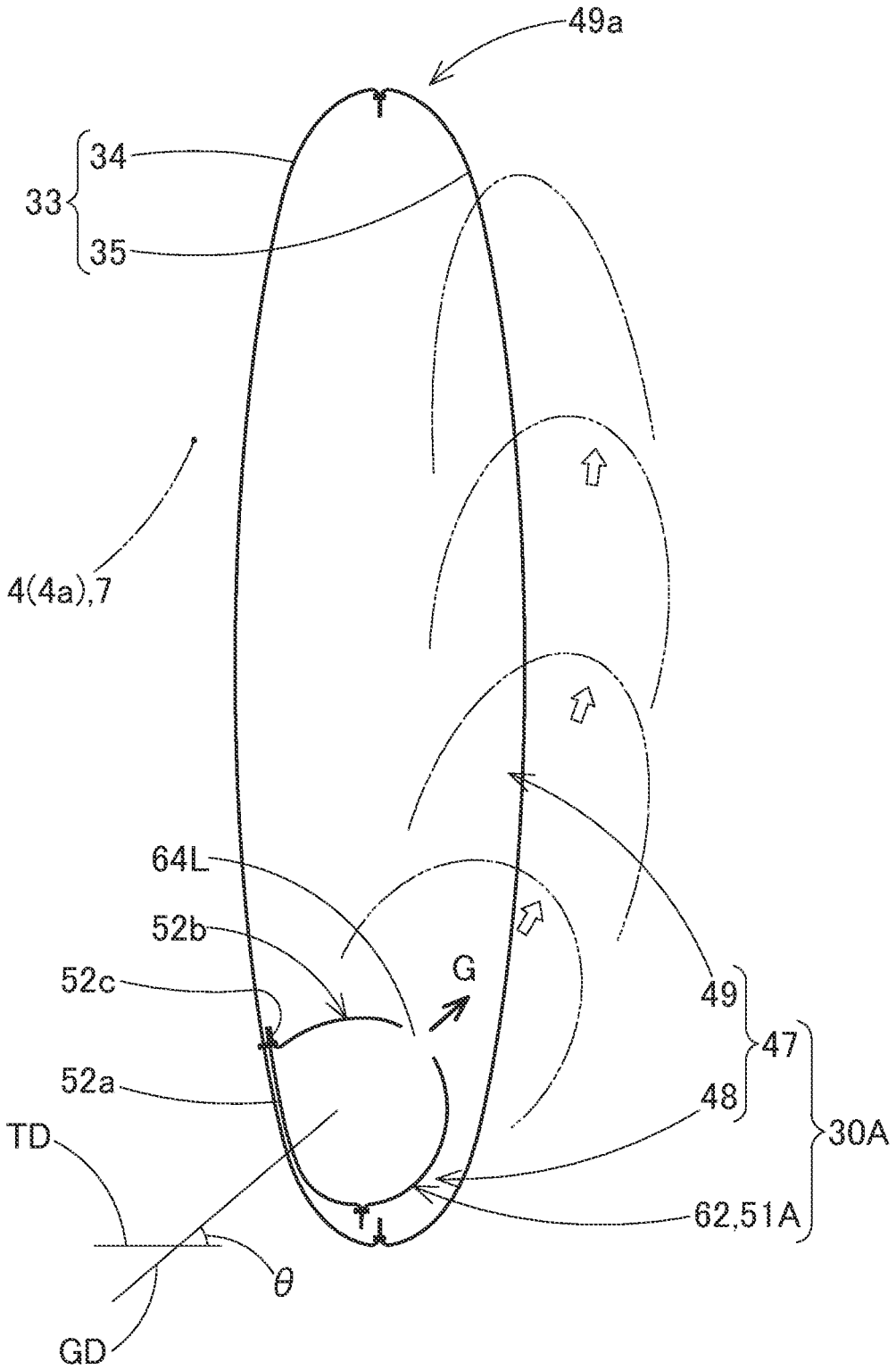
FIG. 8 is a schematic sectional view of an airbag of the second embodiment as inflated taken along line VIII-VIII of FIG. 7.
Figure 9:
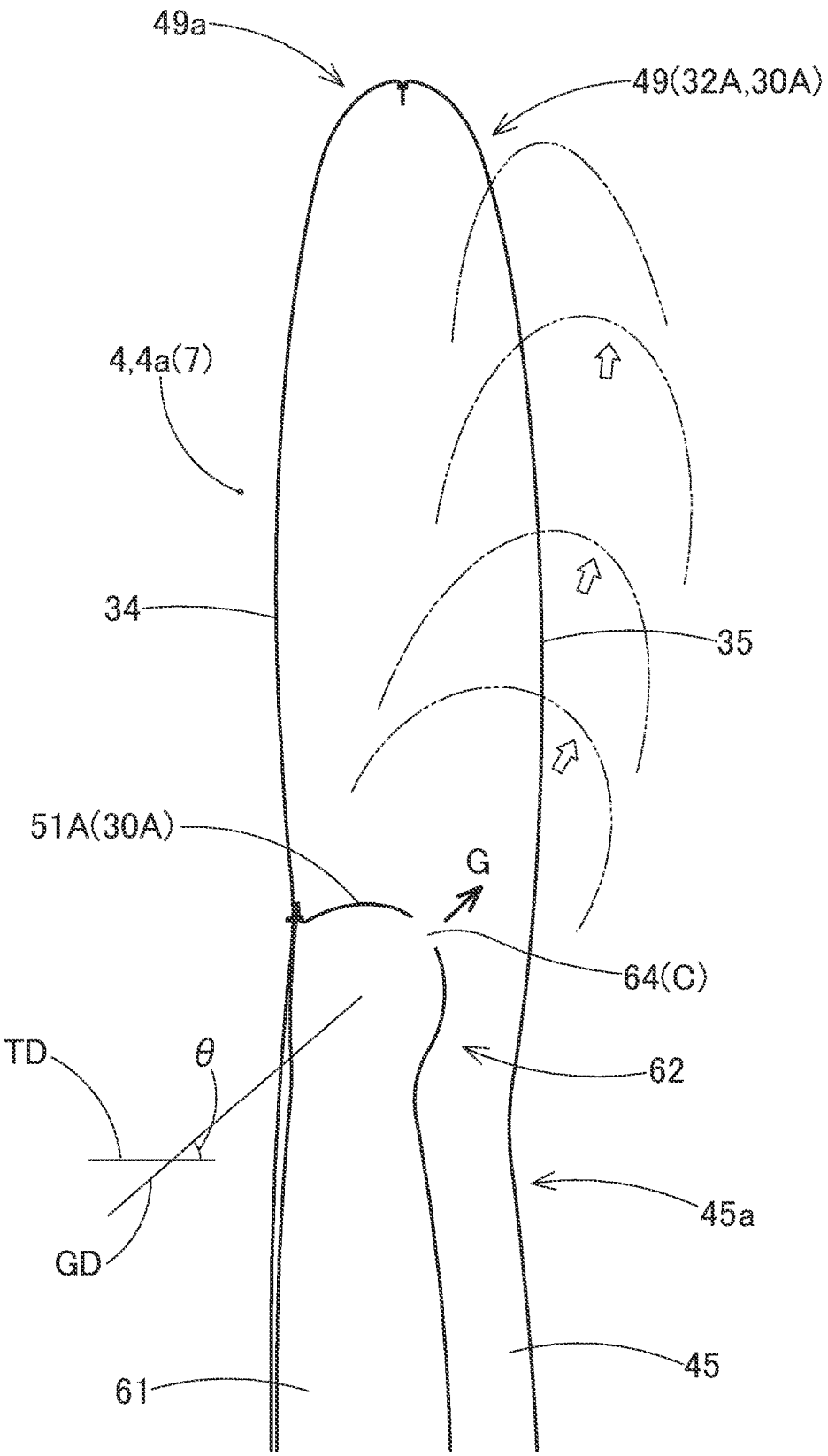
FIG. 9 is a schematic sectional view of the airbag of the second embodiment as inflated taken along line IX-IX of FIG. 7.
Figure 10:
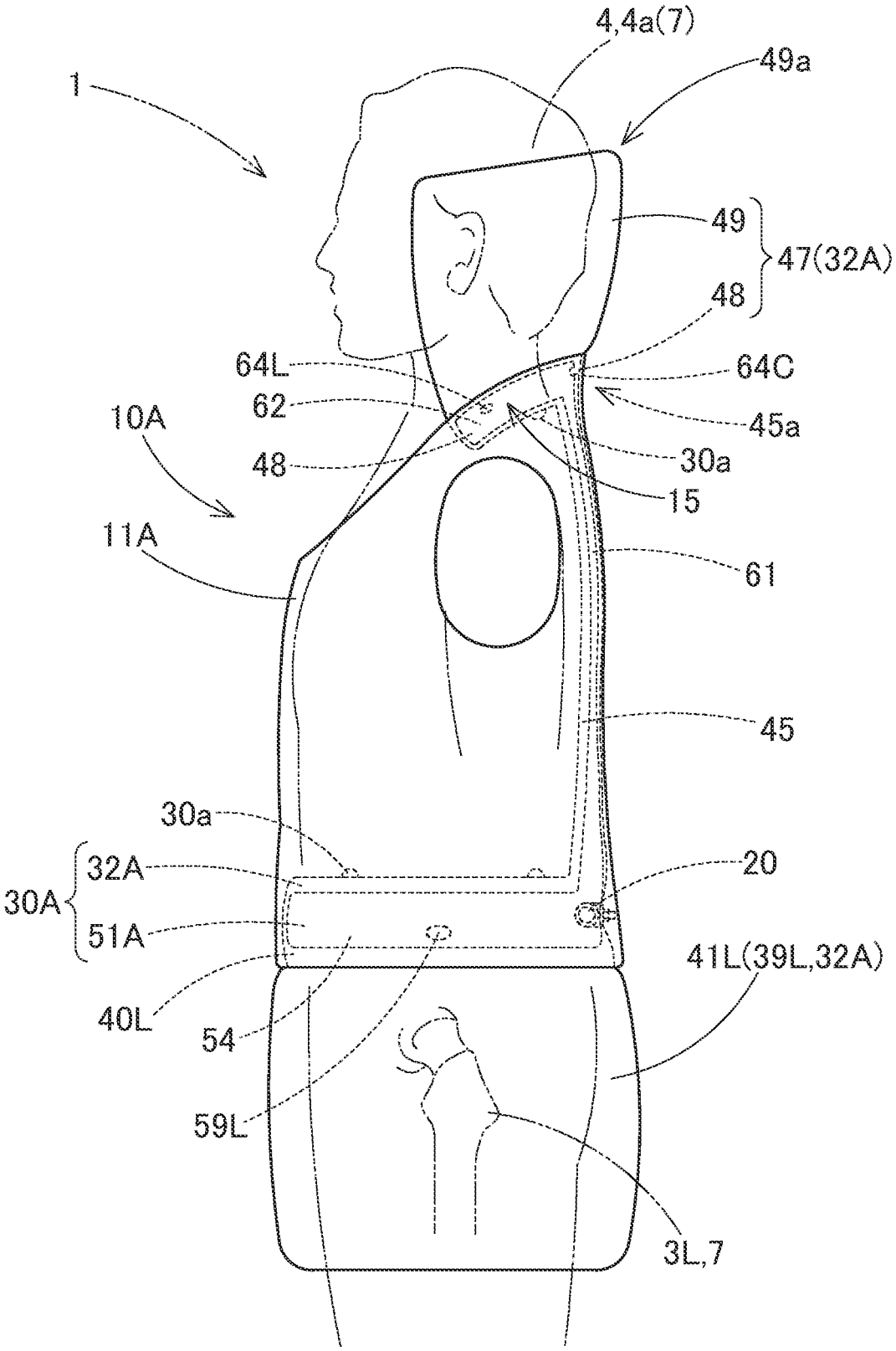
FIG. 10 is a schematic side view of the wearable airbag device of the second embodiment as actuated.

The inner bag 51A includes a vertical tubular portion 61 that extends upward from the central portion 54 and is disposed inside the vertical inflatable portion 45 of the bag body 32A. The inner bag 51A is provided with one or more supply ports 64 in a vicinity of the upper end 61*a* of the vertical tubular portion 61, The inner bag 51A of the second embodiment includes, in the vicinity of the upper end 61*a* of the vertical tubular portion 61, a neck-surrounding portion 62 that is disposed inside the edge inflatable portion 48 of the top-side inflatable portion 47 of the bag body 32A, The neck-surrounding portion 62 is elongated in a horizontal direction. Stored inside the edge inflatable portion 48 which is attached to the neck portion 15 of the wearable member 11, the neck-surrounding portion 62 is disposed in a half ring shape in such a manner as to surround the back of the neck 5 of the wearer 1. A plurality of the supply ports 64 are disposed in the neck-surrounding portion 62 in such a manner as to be arranged along the length direction of the neck-surrounding portion 62, as can be seen in FIG. 7. In the second embodiment, the supply ports 64 are composed of a supply port 64L and a supply port 64R that are located in a vicinity of left and right ends of the neck-surrounding portion 62, respectively, and a supply port 640 that is located at the center in the left and right direction of the neck-surrounding portion 62. Each of the supply ports 64L, 64R, 64C is designed to emit the inflation gas G, from the neck-surrounding portion 62, obliquely upward and outward in an outflow direction GD that obliquely intersects with an opposing direction TD of the inner wall 34 and outer wall 35 of the bag body 32A (which is a substantially horizontal direction) at an approximately 45° angle θ, in a direction drawing away from the head 4 of the wearer 1, as can be seen in FIG. 9. In other words, each of the supply ports 64L, 64R, 64C is designed to emit the inflation gas G toward the outer wall 35 that faces away from the head 4 and toward the leading end (upper end) 49*a* of the head protecting portion 49.

In a vicinity of the hip 2 of the wearer 1, similarly to the first embodiment, the inner bag 51A includes a central portion 54 that houses a gas generator 20, and a left portion 55 and a right portion 57 that respectively extend from opposite ends of the central portion 54 in the left and right direction and is respectively provided with a supply port 59L, 59R. The bag body 32A includes the communicating portion 37 and left and right main inflatable portions 39 (39L, 39R). Each of the main inflatable portions 39L, 39R includes a hip protection portion 41L/41R for covering the trochanter 3L/3R and an edge inflatable portion 40L/40R disposed above the hip protection portion 41L/41R. The central portion 54 of the inner bag 51A is stored inside the communicating portion 37 of the bag body 32A, and the left portion 55 and right portion 57 of the inner bag 51A are respectively stored in the edge inflatable portions 40L, 40R of the bag body 32A.

In the wearable airbag device 10A in accordance with the second embodiment, the bag body 32A as inflated includes, as the protecting inflatable portions, the head protecting portion 49 for protecting the head 4 of the wearer 1, in addition to the left and right hip protecting portions 41L, 41R. Thus the airbag device 10A is able to protect the back 4*a* of the head 4 of the wearer 1 such as an elderly person from the surface such as the road surface in the event of a fall of the wearer 1. The head protecting portion 49 is disposed in the vicinity of the upper end 45*a* of the vertical inflatable portion 45 of the bag body 32A that extends upward from the communicating portion 37. The head protecting portion 49 houses a portion (neck-surrounding portion) 62 of the inner bag 51A that extends upward from the central portion 54 and is provided with the supply ports 64 at a vicinity of the leading end. Since each of the supply ports 64 is configured to emit the inflation gas G in the obliquely upward direction GD toward the outer wall 35 of the bag body 32A and toward the upper end 49*a* of the head protecting portion 49, the gas G will quickly inflate and deploy the head protecting portion 49 without giving an undue pressure to the head 4 of the wearer 1.

Figure 11:
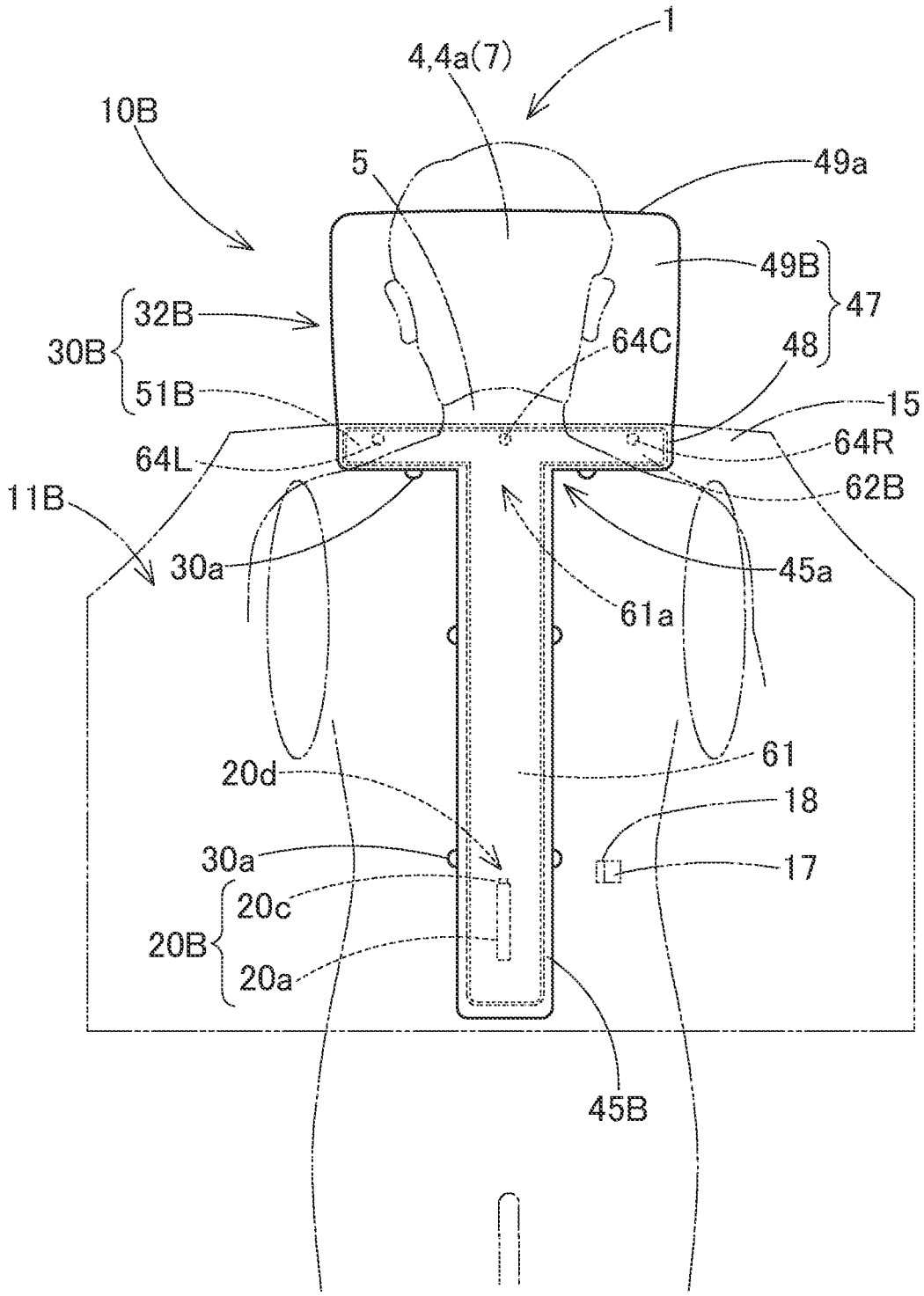
FIG. 11 is a schematic back view of a wearable airbag device in accordance with the third embodiment as laid flat.
Figure 12:
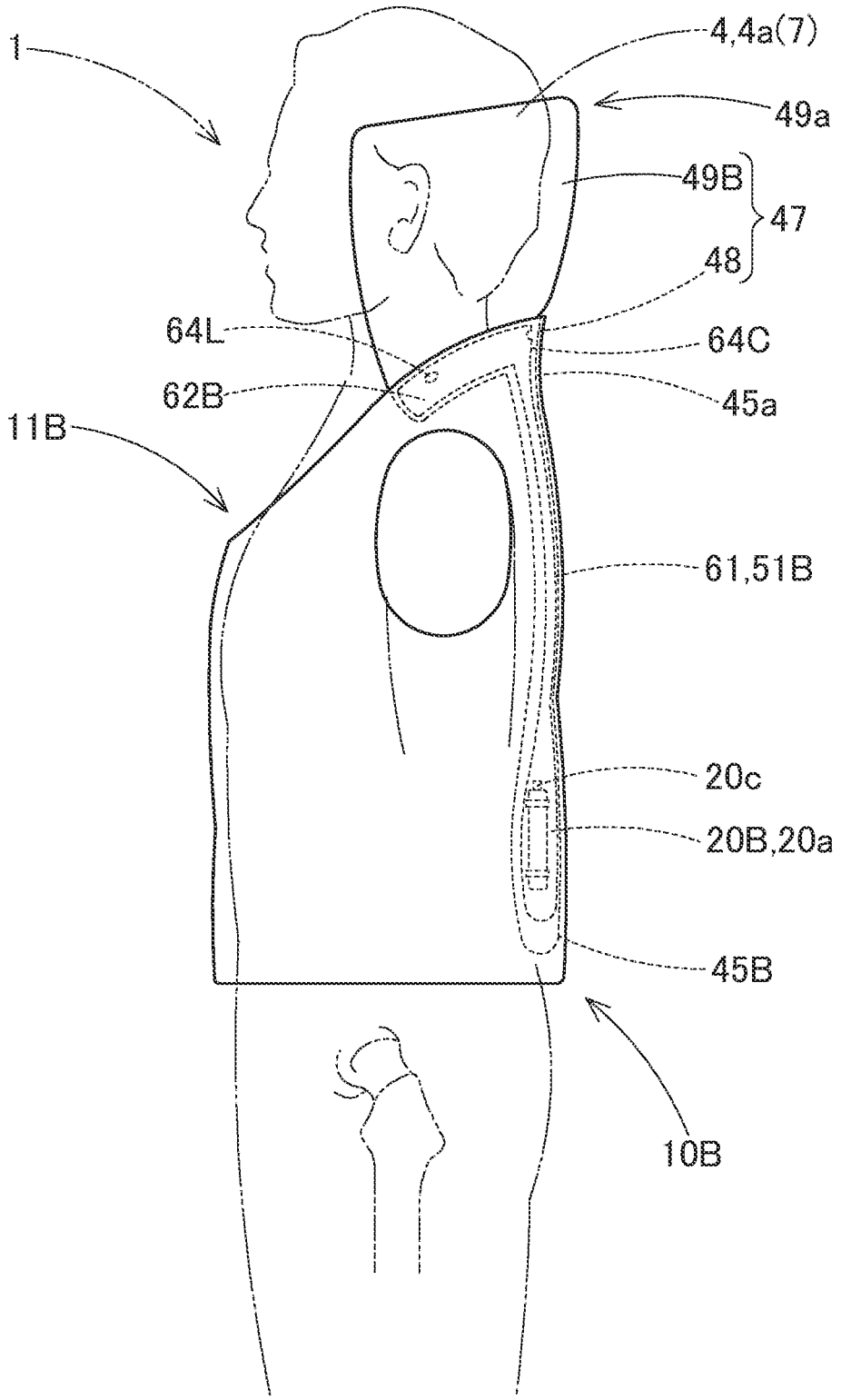
FIG. 12 is a schematic side view of the wearable airbag device of the third embodiment in a worn state.

The bag body may alternatively be configured to include only the head protecting portion 49, with no hip protecting portions, like a bag body 32B depicted in FIGS. 11 and 12. In a wearable airbag device 10B in accordance with the third embodiment, the bag body 32B of an airbag 30B as inflated includes a vertical inflatable portion 45B that is elongated in an up and down direction and adapted to be deployed in a vicinity of the center in a left and right direction of the back of the wearer, and a head protecting portion 49B as the protecting inflatable portion that is located in a vicinity of the upper end 45*a* of the vertical inflatable portion 45B for covering the back 4*a* of the head 4 of the wearer 1. The inner bag 51B is disposed inside the vertical inflatable portion 45B of the bag body 32B so that the upper end 61*a* region is located in a vicinity of the upper end 45*a* of the vertical inflatable portion 45B. The inner bag 51B is configured to receive an inflation gas G from the gas generator 20B at the lower end region, and is provided with one or more supply ports 64 in a vicinity of the upper end 61*a*.

The gas generator 20B of the airbag device 10B of the third embodiment includes a cylindrical body 20*a* and a columnar gas discharge portion 20*c* that is located at the upper end of the body 20*a*, has a smaller diameter than the body 20*a*, and is provided with a gas discharge port 20*d* for emitting an inflation gas G. The gas generator 20B is mounted on the vertical inflatable portion 458 of the bag body 32B together with the inner bag 50B, through the use of not-shown one or more mounting bolts protruding from the body 20*a*.

Similarly to the inner bag 51A of the second embodiment, the inner bag 51B includes, in the upper end region, a neck-surrounding portion 62B that is elongated in a horizontal direction and is adapted to surround the back of the neck 5 of the wearer 1. A plurality of the supply ports 64 (64L, 64R, 64C) of the inflation gas G to the bag body 32B are arranged along the length direction of the neck-surrounding portion 62B in the neck-surrounding portion 62B.

With the configurations of the second and third embodiments, the head protecting portion 49/49B of the bag body 32A/328 is inflated with an inflation gas G supplied from the supply ports 64 (64L, 64R, 64C) arranged side by side in the neck-surrounding portion 62/62B of the inner bag 51A/51B and deployed in such a manner as to extend upward from the circumference of the back of the neck 5 of the wearer 1. The head protecting portion 49/49B will be deployed in a substantially half-pipe shape so as to be able to cover the back 4*a* of the head 4 of the wearer 1, thus will be able to protect the head 4 from the surface such as the road surface even if the head 4 turns sideways upon a fall. Of course, since each of the supply ports 64 (64L, 64R, 64C) disposed in the neck-surrounding portion 62/62B of the inner bag 51A/51B is configured to emit the inflation gas G toward the outer wall 35 of the bag body 32A/32B and toward the head protecting portion 49/49B (more particularly, toward the upper end 49*a* of the head protecting portion 49/49B), that is, obliquely upward and outward from the neck 5, the head protecting portion 49/49B will be quickly inflated and deployed around the back 4*a* of the head 4 in a half-pipe shape, without pushing the head 4 of the wearer 1.

Figure 13:
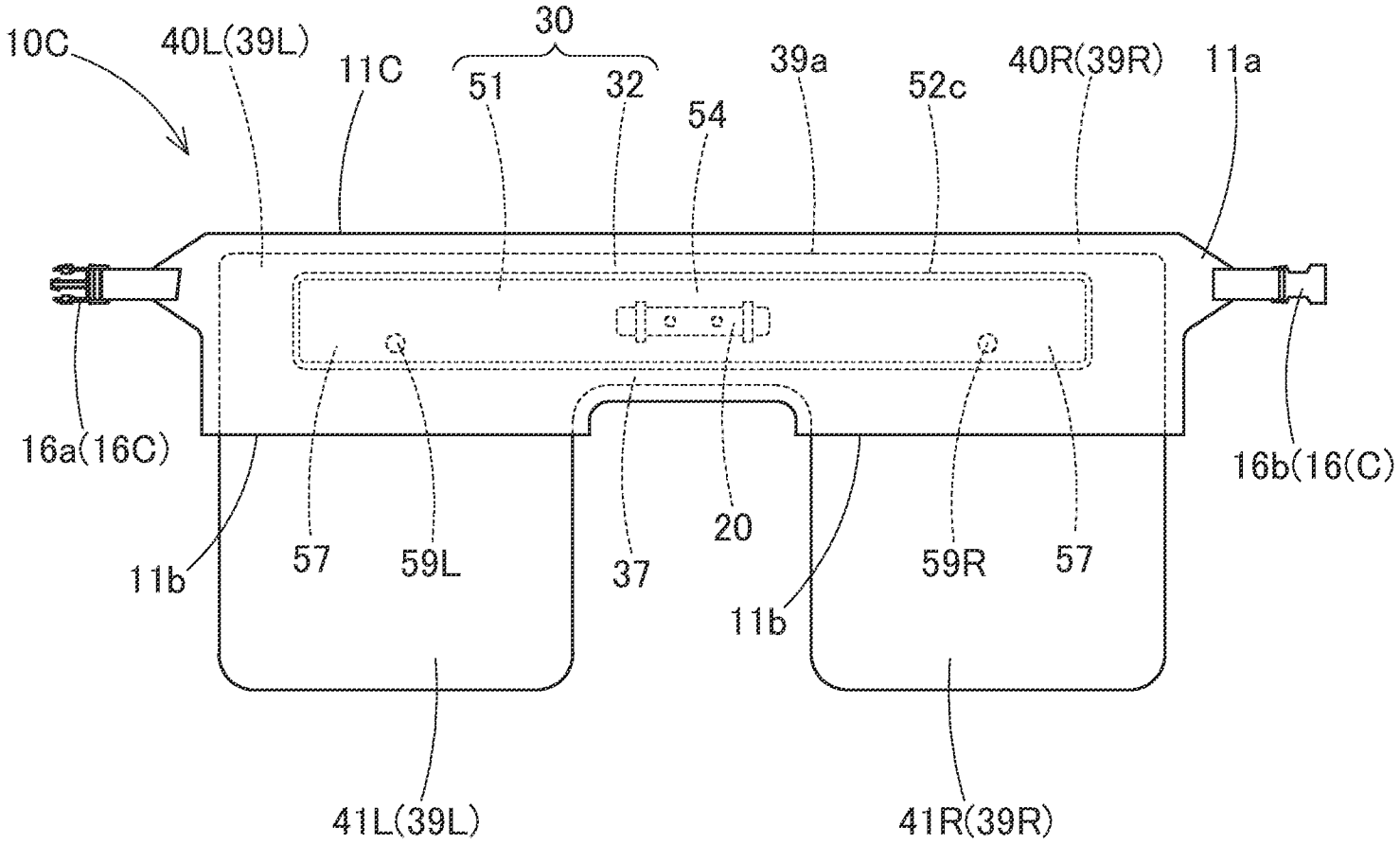
FIG. 13 is a schematic back view of a wearable airbag device of the fourth embodiment as actuated.
Figure 14:
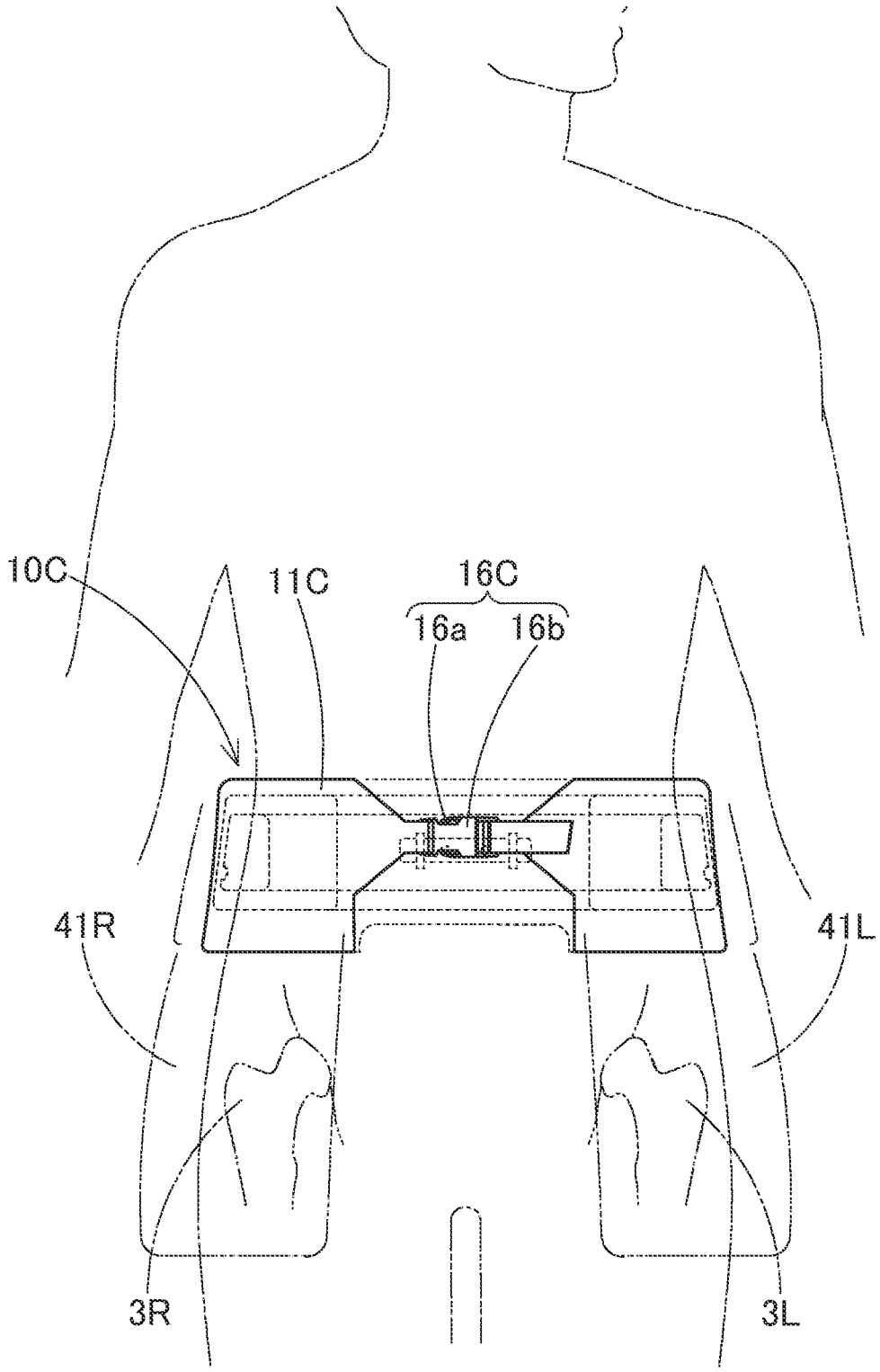
FIG. 14 is a schematic front view of the wearable airbag device of FIG. 13 in a worn state.

Although the wearable members 11, 11A, 11B in the first to third embodiments are each formed into a vest, the wearable member may be formed into a jacket with sleeves. Further alternatively, the wearable member may be formed into a belt-shaped wearable member, like a wearable member 11C depicted in FIGS. 13 and 14. In a wearable airbag device 10C in accordance with the fourth embodiment depicted in FIGS. 13 and 14, the wearable member 11C is shaped into a belt and includes, at the opposite ends, a fastener 16*c* which is composed of a buckle including a male part 16*a* and a female part 16B engageable with one another. The wearable airbag device 10C is composed of the wearable member 11C on which the airbag 30 and the gas generator 20 of the first embodiment are mounted. The wearable member 11C includes a belt body 11*a* which is provided with the fastener 16C at the opposite ends. The belt body 11*a* covers circumferences of the communicating portion 37 and the edge inflatable portions 40 (40L, 40R) disposed in a vicinity of the upper edge 32*a* of the bag body 32. The upper edge 32*a* of the bag body 32 is secured to the belt body 11*a*. The belt body 11*a* includes two insert holes 11*b* that respectively allows the hip protecting portions 41 (41L, 41R) of the bag body 32 to protrude therefrom at airbag deployment. The wearer 1 is able to put on the wearable airbag device 100 by wrapping the wearable member 11C, on which the airbag 30 with the gas generator 20 and so on has been mounted, around a vicinity of the hip 2 and fastening the fastener 16C. When actuated, similarly to the first embodiment, the wearable airbag device 10C will deploy the airbag 30 so that the hip protecting portions 41 (41L, 41R) protrude from the belt body 11*a* and cover the trochanters 3 (3L, 3R) as the targeted body parts 7 of the wearer 1, respectively.

The exemplary embodiment of the present disclosure relates to a wearable airbag device including: a wearable member that is adapted to be worn by a wearer; a gas generator that is held by the wearable member and is configured to discharge an inflation gas; and an airbag that is held by the wearable member and is configured to be inflated with the inflation gas fed from the gas generator for protecting one or more targeted body parts of the wearer. The airbag includes: a bag body that forms an outer shell of the airbag which includes an inner wall that is adapted to face the wearer when worn and an outer wall that is adapted to face away from the wearer when worn, the bag body including one or more protecting inflatable portions that are configured to cover the one or more targeted body parts respectively when inflated; and an inner bag that is disposed inside the bag body and configured to be inflated with the inflation gas fed from the gas generator, the inner bag including one or more supply ports for forwarding the inflation gas fed from the gas generator to the bag body to inflate the bag body. Each of the one or more supply ports of the inner bag is configured to emit the inflation gas toward one of the one or more protecting inflatable portions and toward the outer wall.

If the wearable airbag device in accordance with the exemplary embodiment is actuated, an inflation gas fed from the gas generator inflates the inner bag stored inside the bag body first, then flows into the bag body via the supply ports formed in the inner bag, thus inflates the bag body. At this time, the inflation gas flowing out each of the supply ports flows toward one of the protecting inflatable portions and toward the outer wall, thus inflates the protecting inflatable portion quickly and adequately without pushing the wearer so the protecting inflatable portion is able to cover the targeted body part. Furthermore, since the inflation gas is supplied to the bag body from the supply ports formed on the inner bag, once the inner bag has completed inflation, the opening plane of each of the supply ports is positioned at a predetermined position, so that the deployment behavior of the bag body is stabilized with a stabilized outflow direction of the inflation gas.

Therefore, the wearable airbag device in accordance with the exemplary embodiment is able to stabilize the deployment behavior of the airbag so the airbag is able to cover the targeted body part(s) accurately by stabilizing the flow of the inflation gas at airbag deployment.

In one or more embodiments, each of the one or more supply ports may be configured to emit the inflation gas in a direction that obliquely intersects with an opposing direction of the inner wall and outer wall of the bag body.

This configuration will make the inflation gas flowing out of the inner bag to the bag body flow toward the leading end of each of the protecting inflatable portions in the outer wall, not toward the body of the wearer. Therefore, the wearable airbag device in accordance with the exemplary embodiment is able to attain an avoidance of giving pressure to the wearer as well as quick deployment of the protecting inflatable portions.

In one or more embodiments, the wearable airbag device may be configured as follows: The bag body as inflated includes: two hip protecting portions that are respectively located at left and right regions of the bag body for covering left and right trochanters of femurs of the wearer, each of the two hip protecting portions serving as the protecting inflatable portion; and a communicating portion that is located between the two hip protecting portions in a vicinity of an upper edge of the bag body, the communicating portion being in gas communication with both of the two hip protecting portions, and the communicating portion being adapted to be disposed at the back of the wearer when worn. The inner bag includes: a central portion that is disposed inside the communicating portion of the bag body, the central portion being configured to receive the inflation gas from the gas generator; and a left portion and a right portion that respectively extend from opposite ends of the central portion in a left and right direction, each of the left portion and the right portion being disposed in a vicinity of an upper edge of each of the two hip protecting portions inside the bag body, each of the left portion and the right portion being provided with the one or more supply ports at the leading end.

With this configuration, the wearable airbag device as actuated is able to cover the left and right trochanters of the wearer with the left and right hip protecting portions. By covering the trochanters, the wearable airbag device is able to prevent a fracture or the like of the trochanter of an elderly wearer at fall, which is likely to take a long time to treat. Since the central portion of the inner bag which serves as a reception portion of inflation gas is disposed inside the communicating portion of the bag body which are disposed between the left and right hip protecting portions, when the wearable airbag device is actuated, the inflation gas will be delivered to the left portion and right portion from the central portion evenly, so that the gas will be forwarded to the left and right hip protecting portions via the supply ports to inflate the hip protecting portions evenly and quickly.

In one or more embodiments, the bag body as described above may further include: a vertical inflatable portion that extends upward from the communicating portion and is configured to be deployed in a vicinity of a center in a left and right direction of the back of the wearer; and a head protecting portion that is disposed in a vicinity of an upper end of the vertical inflatable portion and configured to cover the back of the head of the wearer as the protecting inflatable portion. In the meantime, the inner bag may further include a portion that extends upward from the central portion and is disposed inside the vertical inflatable portion of the bag body, the portion that extends upward from the central portion being provided with the one or more supply ports in a vicinity of the upper end.

With this configuration, the bag body as inflated includes, as the protecting inflatable portions, the head protecting portion for protecting the head of the wearer, in addition to the left and right hip protecting portions. Thus the airbag device is able to protect the back of the head of the wearer such as an elderly person from the surface such as the road surface in the event of a fall of the wearer. The head protecting portion is disposed in a vicinity of the upper end of the vertical inflatable portion of the bag body that extends upward from the communicating portion. The head protecting portion houses there inside the portion of the inner bag that extends upward from the central portion and is provided with the supply ports at a vicinity of the leading end. Since each of the supply ports is configured to emit the inflation gas in the obliquely upward direction toward the outer wall of the bag body and toward the head protecting portion, the gas will inflate and deploy the head protecting portion quickly without giving an undue pressure to the head of the wearer.

In one or more embodiments, the bag body may be configured to include only the head protecting portion, with no hip protecting portions. Specifically, the bag body as inflated may include: a vertical inflatable portion that is configured to be inflated and elongated in an up and down direction and adapted to be deployed in a vicinity of a center in a left and right direction of the back of the wearer; and a head protecting portion that is disposed in a vicinity of an upper end of the vertical inflatable portion and configured to cover the back of the head of the wearer as the protecting inflatable portion. The inner bag is disposed inside the vertical inflatable portion of the bag body. The inner bag is configured to receive the inflation gas from the gas generator at the lower end region. The inner bag is provided with the one or more supply ports in a vicinity of the upper end.

When the bag body is provided with the head protecting portion, the inner bag may include, in the vicinity of the upper end, a neck-surrounding portion that is elongated in a horizontal direction and is adapted to surround the back of the neck of the wearer. A plurality of the supply ports are arranged along the length direction of the neck-surrounding portion in the neck-surrounding portion.

With this configurations, the head protecting portion of the bag body is inflated with an inflation gas supplied from the supply ports arranged side by side in the neck-surrounding portion of the inner bag, and deployed in such a manner as to extend upward from the circumference of the back of the neck of the wearer. The head protecting portion will be deployed in a substantially half-pipe shape so as to be able to cover the back of the head of the wearer, thus will be able to protect the head from the surface such as the road surface even if the head turns sideways upon a fall. Of course, since each of the supply ports disposed in the neck-surrounding portion of the inner bag is configured to emit the inflation gas toward the outer wall of the bag body and toward the head protecting portion, that is, obliquely upward and outward from the neck, the head protecting portion will be quickly inflated and deployed around the back of the head in a half-pipe shape, without pushing the head of the wearer,

What is claimed is:

1. A wearable airbag device comprising:

a wearable member that is adapted to be worn by a wearer;

a gas generator that is held by the wearable member and is configured to discharge an inflation gas; and an airbag that is held by the wearable member and is configured to be inflated with the inflation gas fed from the gas generator for protecting one or more targeted body parts of the wearer, wherein the airbag includes:

a bag body that forms an outer shell of the airbag which includes an inner wall that is adapted to face the wearer when worn and an outer wall that is adapted to face away from the wearer when worn, the bag body including one or more protecting inflatable portions that are configured to cover the one or more targeted body parts respectively when inflated; and an inner bag that is disposed inside the bag body and configured to be inflated with the inflation gas fed from the gas generator, the inner bag including one or more supply ports for forwarding the inflation gas fed from the gas generator to the bag body to inflate the bag body;

wherein each of the one or more supply ports of the inner bag is configured to emit the inflation gas toward one of the one or more protecting inflatable portions and toward the outer wall, wherein an upper edge side of the inner bag is joined to the inner wall of the bag body, wherein the bag body as inflated includes:

two hip protecting portions that are respectively located at left and right regions of the bag body for covering left and right trochanters of femurs of the wearer, each of the two hip protecting portions serving as the protecting inflatable portion; and a communicating portion that is located between the two hip protecting portions in a vicinity of an upper edge of the bag body, the communicating portion being in gas communication with both of the two hip protecting portions, and the communicating portion being adapted to be disposed at the back of the wearer when worn; and the inner bag includes:

a central portion that is disposed between the two hip protecting portions, the central portion being configured to receive the inflation gas from the gas generator; and a left portion and a right portion that respectively extend from opposite ends of the central portion in a left and right direction, each of the left portion and the right portion being disposed in a vicinity of an upper edge of each of the two hip protecting portions inside the bag body, wherein the one or more supply ports comprise at least two supply ports, and each of the left portion and the right portion are provided with a supply port of the one or more supply ports at a leading end thereof.

2. The wearable airbag device of claim 1, wherein each of the one or more supply ports is configured to emit the inflation gas in a direction that obliquely intersects with an opposing direction of the inner wall and outer wall of the bag body.

3. The wearable airbag device of claim 1, wherein:

the bag body as inflated further includes:

a vertical inflatable portion that extends upward from the communicating portion and is configured to be deployed in a vicinity of a center in a left and right direction of the back of the wearer; and a head protecting portion that is disposed in a vicinity of an upper end of the vertical inflatable portion and configured to cover the back of the head of the wearer as the protecting inflatable portion; and the inner bag further includes a portion that extends upward from the central portion and is disposed inside the vertical inflatable portion of the bag body, the portion that extends upward from the central portion being provided with the one or more supply ports in a vicinity of an upper end thereof.

4. The wearable airbag device of claim 3, wherein:

the portion of the inner bag that extends upward from the central portion includes, in the vicinity of the upper end, a neck-surrounding portion that is elongated in a horizontal direction and is adapted to surround the back of the neck of the wearer; and a plurality of the supply ports are arranged along a length direction of the neck-surrounding portion in the neck-surrounding portion.

5. The wearable airbag device of claim 1, wherein:

the bag body as inflated includes:

a vertical inflatable portion that is configured to be inflated and elongated in an up and down direction and adapted to be deployed in a vicinity of a center in a left and right direction of the back of the wearer; and a head protecting portion that is disposed in a vicinity of an upper end of the vertical inflatable portion and configured to cover the back of the head of the wearer as the protecting inflatable portion;

the inner bag is disposed inside the vertical inflatable portion of the bag body;

the inner bag is configured to receive the inflation gas from the gas generator at a lower end region thereof; and the inner bag is provided with the one or more supply ports in a vicinity of an upper end thereof.

6. The wearable airbag device of claim 5, wherein each of the one or more supply ports is configured to emit the inflation gas in a direction that obliquely intersects with an opposing direction of the inner wall and outer wall of the bag body.

7. The wearable airbag device of claim 5, wherein:

the inner bag includes, in the vicinity of the upper end, a neck-surrounding portion that is elongated in a horizontal direction and is adapted to surround the back of the neck of the wearer; and a plurality of the supply ports are arranged along a length direction of the neck-surrounding portion in the neck-surrounding portion.

* * * * *